United States Patent [19]

Gillean

[11] Patent Number: 5,036,688

[45] Date of Patent: Aug. 6, 1991

[54] FENDER FORMING SYSTEM

[75] Inventor: Danny J. Gillean, Dallas, Tex.

[73] Assignee: Quality Trailer Products Corporation, Azle, Tex.

[21] Appl. No.: 452,760

[22] Filed: Dec. 18, 1989

[51] Int. Cl.[5] ..... B21D 5/14

[52] U.S. Cl. ..... 72/7; 72/17; 72/168; 72/172; 72/173

[58] Field of Search ..... 72/168, 172, 173, 177, 72/7, 6, 17

[56] References Cited

U.S. PATENT DOCUMENTS

| | | | |
|---|---|---|---|
| 1,166,814 | 1/1916 | Cleesattel | 72/168 |
| 1,296,199 | 3/1919 | Lundahl | 72/168 |
| 1,376,497 | 5/1921 | Yoder | 72/168 |
| 1,588,817 | 6/1926 | Smith | 72/168 |
| 3,848,446 | 11/1974 | Iwasaki | 72/168 |
| 4,232,540 | 11/1980 | Cain | 72/173 |
| 4,796,449 | 1/1989 | Berne | 72/173 |

FOREIGN PATENT DOCUMENTS

| | | | |
|---|---|---|---|
| 156025 | 7/1987 | Japan | 72/168 |

*Primary Examiner*—Daniel C. Crane

*Attorney, Agent, or Firm*—James E. Bradley

[57] ABSTRACT

A system of forming a curve in a substantially planar portion of a fender blank consists of a plurality of components and steps. First and second substantially parallel rollers are provided having selected diameters with a gap therebetween adapted to receive the substantially planar portion of the fender blank. A forming shoe is provided at a forming region on one side of the first and second substantially parallel rollers. A substantially planar portion of the fender blank is inserted in the gap. At least one of the first and second substantially parallel rollers is advanced to rotate a selected length of the substantially planar portion of the fender blank through the gap to the forming region. At least one of the first and second substantially parallel rollers is rotated to retract a selected length of the fender blank from the forming region through the gap at a selected rate, while simultaneously the forming shoe is moved through a selected angle at a selected rate to bear upon the fender blank. The first and second substantially parallel rollers and the forming shoe cooperate to form a curve of selected radius in the substantially planar portion of the fender blank.

18 Claims, 3 Drawing Sheets

FENDER FORMING SYSTEM

BACKGROUND OF THE INVENTION

1. Field of the Invention

This invention relates generally to a fender forming system, and specifically to a method and apparatus for forming a curve in a substantially planar portion of a fender blank.

2. Description of the Prior Art

The fenders for tandem wheel trailers, such as truck trailers, horse trailers, and boat trailers, have a curved portion on each end and a straight portion in the middle. These fenders have been made in the prior art by first cutting a substantially planar plate to shape with a dye cut machine. In the industry, this plate is referred to as a "fender blank." Normally, a flange will be formed on one or more edges of the fender blank by a press. Then, each end of the fender blank is rolled through a rolling machine to form the curved portion on each end.

The prior art roller machines have a pair of driven pinch rollers that are spaced to receive the workpiece between them. Guide rollers are located on the front and back of the pinch rollers. The guide rollers are positioned to cause the workpiece to bend as it passes through the pinch rollers. This results in the curve.

The prior art roller machines "rolled" the workpiece by simultaneously forcing the workpiece through the pinch rollers and bending the workpiece. The prior art systems often require multiple passes of the workpiece through the rollers to achieve the desired degree of curvature. These systems are manually operated, and consequently subject to human error, waste of materials, inaccuracy, defective or substandard fenders, and inconsistency. Moreover, this process is labor intensive, requiring extensive training, and resulting in considerable manufacturing expense.

A number of significant manufacturing problems and product defects were encountered in the prior art including scuffs, bows, crimps, and knots. Scuffing results when the pinch rollers worked against the fender blank to abrade the outer surface, detracting from the appearance of the fender. Bows also occur in the use of pinch rollers, and are characterized by undesired curvature in the width of the fender blank. Crimps are common manufacturing errors, characterized by a wrinkle or gathering of a portion of the fender usually at or near the flange formed along the edge of the fender. Knots are also common in the prior art systems, and are characterized by a distortion in the material at the transition of the planar portion of the fender to the curved portion of the fender.

SUMMARY OF THE INVENTION

The present fender forming system comprises a method and an apparatus. The method of forming a curve in a substantially planar portion of a fender blank comprises a plurality of steps. First and second substantially parallel rollers are provided having selected diameters with a gap therebetween adapted to receive the substantially planar portion of the fender blank. Also, a forming shoe is provided at a forming region on one side of the first and second substantially parallel rollers. A substantially planar portion of the fender blank is inserted in the gap. The first and second substantially parallel rollers are rotated to advance a selected length of the substantially planar portion of the fender blank through the gap to the forming region. At least one of the first and second substantially parallel rollers is rotated to retract a selected length of the fender blank from the forming region through the gap at a selected rate, while the forming shoe is moved through a selected angle at a selected rate to bear against the fender blank. The first and second substantially parallel rollers and forming shoe cooperate to form a curve of selected radius in the substantially planar portion of the fender blank.

As an apparatus, the fender forming system for forming a curve in a substantially planar portion of a fender blank comprises a plurality of components. These components include a frame, a first roller rotatably carried by the frame, and a second roller substantially parallel to the first roller and rotatably carried by the frame. A gap is provided between the first and second rollers which is adapted to allow passage of a selected length of the substantially planar portion of the fender blank from a loading region on one side of the first and second rollers to a forming region on the opposite side of the first and second rollers. Means for rotating the first and second rollers is provided to selectively advance and retract the fender blank through the gap at selected rates. A forming shoe is provided in the forming region proximate to but non-obstructive of the gap during a loading stage in which a selected length of substantially planar portion of the fender blank is pulled through the gap from the loading region by the first and second rollers when advanced by the means for rotating. A means is also provided for moving the forming shoe through a selected angle at a selected rate causing the forming shoe to bear against the fender blank. The first and second rollers and forming shoe cooperate to form a curve in a substantially planar portion of the fender blank during a forming stage in which the first and second rollers are rotated by the means for rotating to retract the fender blank through the gap at a selected rate while the forming shoe is simultaneously moved through a selected angle at a selected rate to bear against the fender blank.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
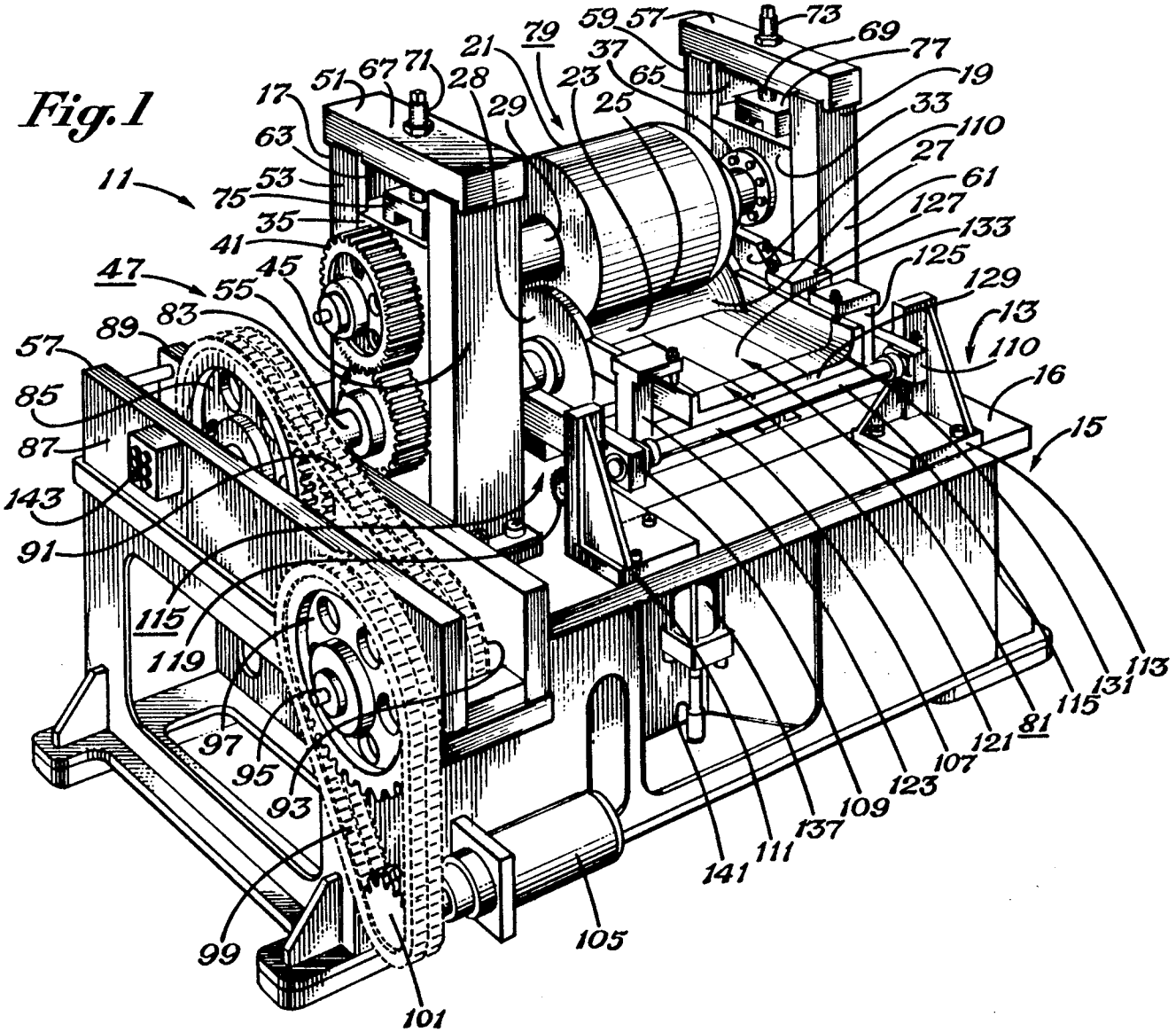
FIG. 1 is perspective view of the fender forming apparatus of the present invention.

FIG. 1 is a perspective view of the fender forming apparatus of the present invention. Fender forming apparatus 11 has a frame with table 16 disposed on base 15. Additionally, roller stands 17, 19 are aligned, spaced apart, and bolted to table 6 of frame 13. First roller and second roller 23 are rotatably carried between roller stands 17, 19 of frame 13. In the preferred embodiment, first roller 21 comprises a male dye, and second roller 23 comprises a female dye, said male and female dyes being matched to provide a precision fitting of the rollers. Second roller 23 has two outer flanges 27, 28 which overlap part of the ends of first roller 21. A gap 25 is provided between first roller 21 and second roller 23, dimensioned to accommodate a substantially planar fender blank. First roller 21 and second roller 23 do not serve as pinch rollers to compress or otherwise deform the fender blank.

Figure 6:
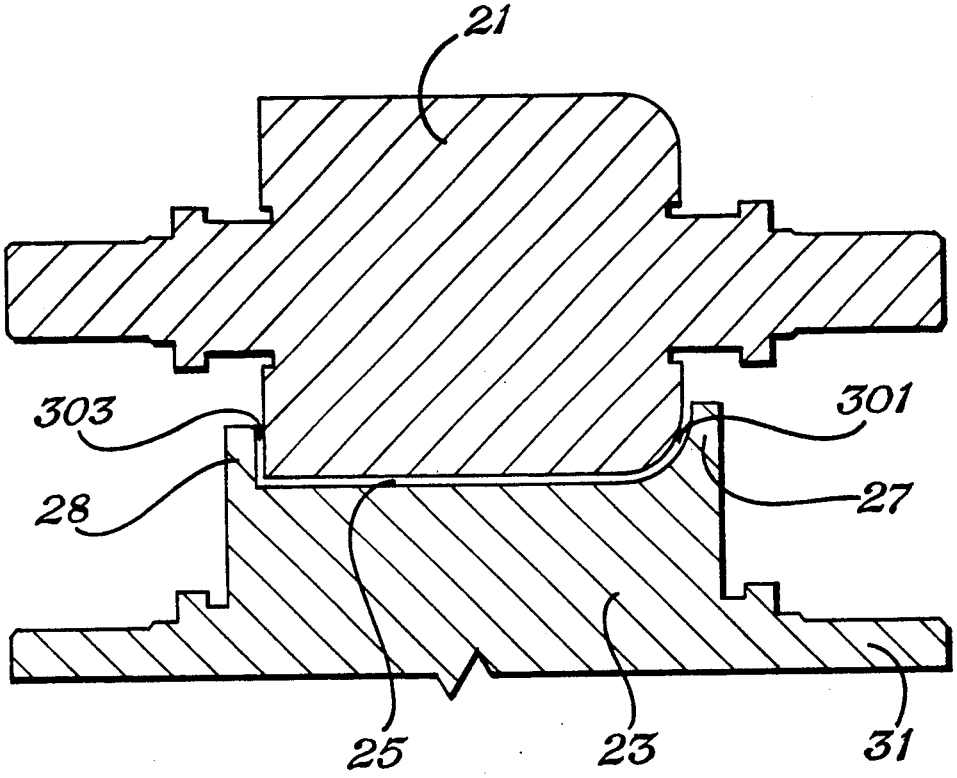
FIG. 6. depicts in partial longitudinal section, the first and second substantially parallel rollers of the present invention.

In FIG. 6, the first and second substantially parallel rollers 21, 23 of the present invention are shown in partial longitudinal section. First roller 21 is a male dye disposed above and substantially parallel to second roller 23, which is a female dye. Gap 25 is provided between first roller 21 and second roller 23. Flange 27 of second roller 23 overlaps one end of first roller 21, forming a curve 301. At the opposite end, flange 28 of lower roller 23 forms a 90° lip 303 with upper roller 21.

Figure 7:
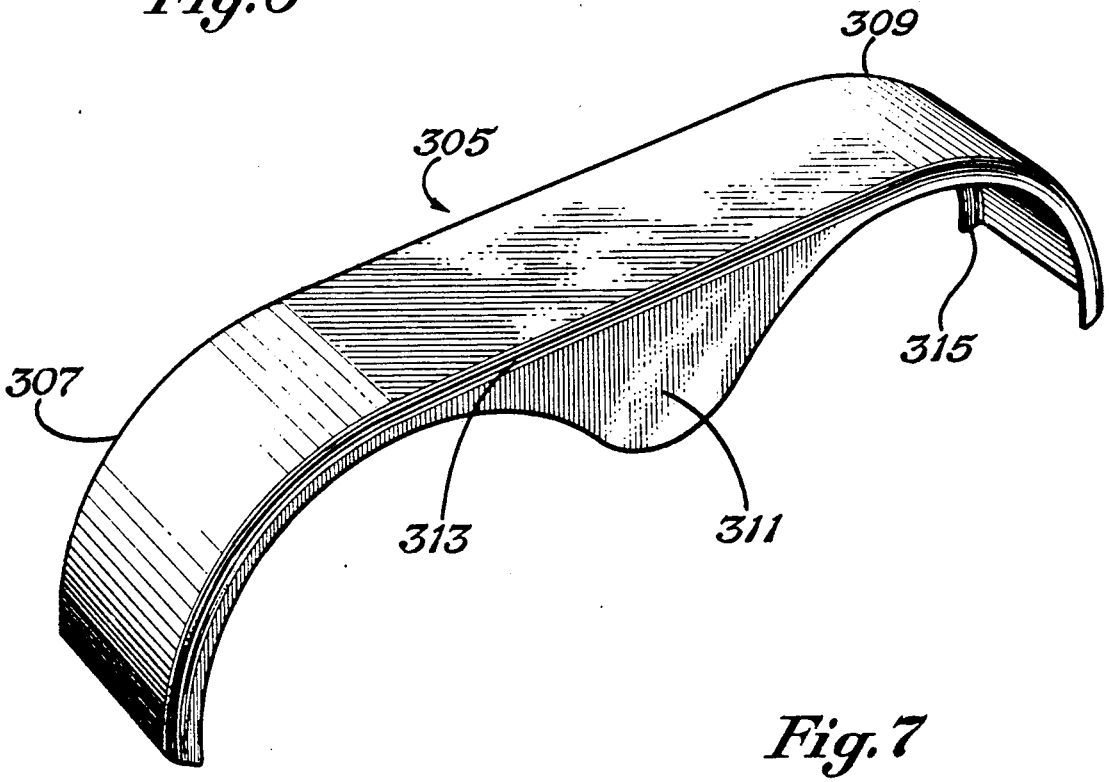
FIG. 7 is a perspective view of a tandem fender having curves at both ends which were produced with the present fender forming system.

FIG. 7 provides a perspective view of a tandem tear-drop fender 305 having Curves 307, 309 at both ends produced with the present fender forming apparatus. Tear-drop valance 311 provides ornamentation to the tandem tear-drop fender 305. Tear-drop valance 311 has a curved longitudinal edge 313 which is accommodated by curve 30 between first roller 21 and second roller 23 during the fender forming process of the present invention. On the opposite side of tandem tear-drop fender 305, lip 315 is provided, which is accommodated by 90° lip 303 between first roller 21 and second roller 23. Prior to processing, a "fender blank" is a substantially planar section of metal having tear-drop valance 311, curved longitudinal edge 313, and 90° lip 315. Curves 307, 309 are formed thereon by the fender forming system of the present invention.

Returning now to FIG. 1, first roller 21 is rotatably carried on frame 13 by shaft 29. Likewise, second roller 23 is rotatably carried on frame 13 by shaft 31 (obscured in FIG. 1, but visible in FIG. 6). First roller 21 is adjustable in position relative to second roller 23 to alter the size of gap 25, and to allow for the operation of fender forming apparatus 11 upon fender blanks having differing thickness. Shaft 29 of first roller 21 is coupled at each end to sliding blocks 33, 35. Sliding blocks 33, 35 are in turn slidably carried by roller stands 17, 19. More specifically, sliding block 33 is slidably carried by roller stand 19, while sliding block 35 is slidably carried by roller stand 17. Shaft 29 terminates in sliding block 33 at circular flange 37 and bearing 39 (obscured in FIG. 1). The opposite end of shaft 29 extends through sliding block 35 and terminates by coupling to spur gear 41.

Shaft 31 of second roller 23 is similar to shaft 29, except shaft 31 is not adjustable in position relative to shaft 29. Shaft 31 terminates at roller stand 19 at end bearing 43 (obscured in FIG. 1). The opposite end of shaft 31 extends through a bore in roller stand 17 and terminates at spur gear 45. Spur gear 45 intermeshes with spur gear 41, allowing first roller 21 and second roller 23 to rotate in opposite directions but at identical speeds. In the present embodiment, means for rotating 47 acts upon spur gear 45, and spur gear 45 in turn acts upon spur gear 41, causing shafts 29, 31 to rotate at a substantially identical speed. However, it is possible and perhaps advantageous to rotate first roller 21 and second roller 23 at different speeds, in alternate embodiments.

As discussed above, first roller 21 is substantially parallel to second roller 23, and adjustable in position relative to second roller 23 to widen or narrow gap 25 to accommodate fender blanks having a variety of thicknesses. The adjustment is accomplished through the positioning of sliding blocks 33, 35 relative to roller stands 17, 19. Roller stand 17 comprises a pair of oppositely facing end plates 53, 55 which are bolted to table 16, and which have inner grooves 63, 64 (inner grove 64 is obscured in FIG. 1) adapted to interlock with sliding block 35. Likewise, sliding block 33 is slidably carried between oppositely facing end plates 59, 61 of roller stand 19 which are bolted to table 16. End plates 59, 61 also have inner grooves 65, 66 (inner groove 66 is obscured in FIG. 1) adapted to interlock with sliding block 33.

Top plate 51 spans the distance between end plate 53 and end plate 55 of roller stand 17. Likewise, top plate 57 spans the distance between end plate 59 and end plate 61 of roller stand 19. Threaded rod 67 extends downward through top plate 51 of roller stand 17 and couples to spacer 75 which is in turn coupled to sliding block 35. Locknut 71 is coupled by threads to the upper end of threaded rod 67, allowing for the vertical adjustment of sliding block 35 relative to roller stand 17. At roller stand 19, threaded rod 69 extends through top plate 57 and couples to spacer 77 which is coupled to sliding block 33. Locknut 73 is coupled by threads to the upper end of threaded rod 69 and allows for the vertical adjustment of sliding block 33 relative to roller stand 19.

In Operation, locknuts 71, 73 are advanced or retracted the same distance along threaded rods 67, 69 to raise or lower sliding blocks 33, 35 and to reposition shaft 29 and first roller 21 relative to second roller 23. Ordinarily, the range of distances required for gap 25 is quite small, and should not result in a decoupling of spur gears 41 and 45. If, however, a substantial gap 25 is required between first roller 21 and second roller 23, spur gear 41 may be removed and replaced with another larger gear to ensure proper coupling of spur gears 41, 45.

Spur gears 41, 45 are rotated by the coordinated action of a plurality of interconnected gears, sprockets, shafts, and chains. Spur gear 45 is coupled to one end of drive shaft 83. Drive sprocket 85 couples to the opposite end of drive shaft 83. Drive sprocket 85 is in turn linked via chain 91 to gear 93. Gear 93 is in turn coupled via shaft 95 to gear 97. Finally, gear 97 is linked by chain 99 to sprocket 101 of hydraulic motor 103. In operation, hydraulic motor 103 advances or reverses sprocket 101 which drives chain 99 and coupled gear 97. Through shaft 95, gear 97 rotates gear 93, which in turn advances or retracts chain 91 to act upon drive sprocket 85 and drive shaft 83. Drive shaft 83 and shaft 95 are rotatably carried by parallel chain guard plates 87, 89.

In the embodiment of FIG. 1, gap 25 between first roller 21 and second roller 23 links a loading region 79 on one side of the first and second rollers 21, 23 to a forming region 81 on the opposite side of the first and second rollers 21, 23. Forming shoe 105 is disposed at said forming region 81, and comprises a plurality of components including lift platform 107, and yokes 109, 110. Lift platform 107 is a substantially planar sheet of metal that is pivotally coupled about shaft 1 by yokes 109, 110. Yokes 109, 110 are Y-shaped, for coupling to shaft 31 on each side of second roller 23, allowing forming shoe 105 to pivot upward and downward about shaft 31 relative to first roller 21 and second roller 23 through an arc.

The side of lift platform 107 opposite gap 25 is coupled to lift brackets 111, 113 through rack in pinion gears 115, 116 respectively. More specifically, pinion gears 119, 120 are coupled to the underside of lift platform 107 at opposite sides of lift platform 107. Racks 117, 118 (obscured in FIG. 1) are vertically disposed along lift brackets 111, 113 respectively, facing, and intermeshing with pinion gears 119, 120. This rack and pinion coupling of lift platform 107 to lift brackets 111, 113 serves to ensure uniform upward and downward motion of the lift platform 107 relative to first and second rollers 21, 23.

Forming shoe 105 also consists of a curved forming plate 121 which is disposed along the top of lift platform 107 and secured thereto by adjustment brackets 123, 125, and 127. Curved forming plate 121 comprises three pieces: side plate piece 129, side plate piece 131, and removable centerpiece 133. Side plate piece 129 is releasably secured to lift platform 107 by adjustment bracket 123. Side plate piece 131 is releasably secured to lift platform 107 by adjustment 125, 127. Removable center plate piece 133 may be replaced with larger or smaller replacement center plate pieces to enlarge or expand the surface area of curved forming plate 121. The principal function of curved forming plate 121 is to guide fender blanks through gap 25; since forming plate is adjustable it can accommodate a variety of fender blank types having differing widths. First and second rollers 121, 123 are likewise adjustable in width to accommodate fender blanks having different widths. For purposes of clarity, FIG. 1 omits the spacer elements required to expand or contract the width of first and second rollers 121, 123.

Forming shoe 105 is pivotal relative to first roller 21 and second roller 23. During a loading stage, forming shoe 105 is proximate to but non-obstructive of gap 25, allowing a selected length of a substantially planar portion of a fender blank to be advanced from loading region 79 to forming region 81. However, during a forming stage, forming shoe 105 serves to bear against the substantially planar portion of the fender blank as the fender blank is retracted through gap 25 by first and second rollers 21, 23. Hydraulic cylinder 137 is provided to urge forming shoe 105 upward and downward when required. Piston 139 (obscured in FIG. 1) is disposed in part in hydraulic cylinder 137. Adjustment screw 141 is provided to limit the length of the stroke of piston 139 within hydraulic cylinder 137. When piston 139 is stroked in one direction in hydraulic cylinder 137, it is forced upward, urging forming shoe 105 to pivot upward through an angle about shaft 31 at yokes 109, 110. When piston 139 is stroked in the opposite direction in hydraulic cylinder 139, it is forced downward, urging forming shoe 105 to pivot downward through an angle about shaft 31 at yokes 109, 110.

Sensing wheel 135 is disposed in loading region 79, and obscured by first roller 21 in FIG. 1. Sensing wheel 135 is provided to measure the length of the fender blank advanced through gap 25 by the rotation of first and second rollers 21, 23. Sensing wheel 135 and hydraulic motor 103 can cooperate through controller 143 to advance or retract selected lengths of fender blank through gap 25.

Controller 143 is provided to coordinate the operation of sensing wheel 135, hydraulic motor 103, and hydraulic cylinder 137. In the preferred embodiment, controller 143 is a Durant Systems 6450 brand programmable sequence controller manufactured by Eaton Advanced Electronics. It is a sixteen output device having an internal clock. Controller 143 serves to control the direction and speed of rotation of hydraulic motor 103, and therefore the direction and speed of rotation of first roller 21 and second roller 23. It further controls the direction and speed of motion of piston 139 within hydraulic cylinder 137, and thus controls the direction and speed of motion of forming shoe 105.

Controller 143 receives sensor data from sensing wheel 135 which is indicative of the length of fender blank advanced or retracted through gap 25 by first roller 21 and second roller 23. Controller 143 may be programmed to perform a sequence of steps, allowing the user to select the speed and direction of rotation of first roller 21 and second roller 23, the speed and direction of movement of forming shoe 105 relative to first roller 21 and second roller 23. Finally, controller 143 receives sensor data from sensing wheel 135 concerning the length of the fender blank advanced through gap 25. This data allows the coordinated operation of first roller 21 and second roller 23 with forming shoe 105.

One component of fender forming apparatus 11 of FIG. 1 has been omitted for purposes of clarity. Wiper 145 is coupled at each end of roller stands 17, 19, provided in forming region 79 adjacent to gap 25, carried substantially parallel to curved forming plate 121, and disposed several inches above the curved forming plate 121 when forming shoe 105 is parallel to table 16. However, when forming shoe 105 is pivoted upward through its full range, wiper 145 is separated from forming shoe 105 by only a distance sufficient to allow the passage of the fender blank. Thus, wiper 145 serves to prevent buckling of the fender blank during the forming process. While not depicted in FIG. 1, wiper 145 is depicted in FIGS. 2 through 5.

While not shown in FIG. 1, it is possible to provide two forming shoes 105, one located in forming region 81 as shown in FIG. 1, and another located in loading region 79. Such a configuration requires the placement of an identical forming shoe 105, wiper 145 and hydraulic cylinder 137 of FIG. 1 at the loading region 79. This configuration allows the fender forming apparatus 11 to be operated from both sides.

Figure 2:
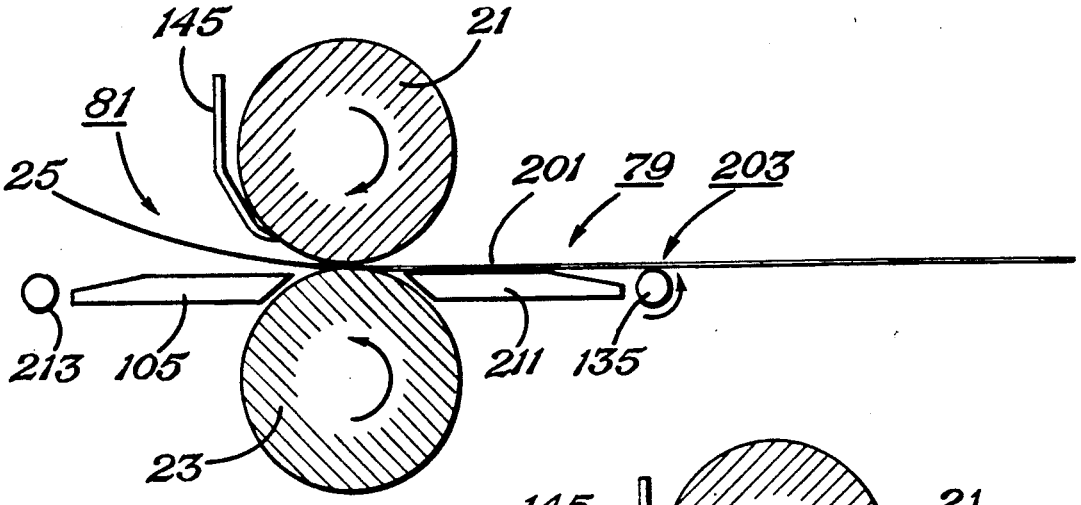
FIGS. 2, 3, 4, and 5 depict the method steps of the present invention.

Turning now to FIGS. 2 through 5, the method of forming a curve in a substantially planar portion of a fender blank will be described. Turning to FIG. 2, first roller 21 and second roller 23 are provided. They are substantially parallel rollers having selected diameters with a gap 25 therebetween adapted to receive substantially planar portion 201 of fender blank 203. A forming shoe 105 is provided at a forming region 81 on one side of first roller 21 and second roller 23.

Substantially planar portion 201 of fender blank 203 is inserted in gap 25. Then, at least one of said first and second rollers 21, 23 is rotated to advance a selected length of substantially planar portion 201 of fender blank 203 through gap 25 to the forming region 81. Sensing wheel 135 is provided to sense and control the length of fender blank 203 advanced through first and second rollers 21, 23.

Controller 143 of FIG. 1 may be programmed to advance a particular length of fender blank 203 through gap 25 for forming a curve therein. Controller 143, sensing wheel 135, and first and second roller 21, 23 cooperate to advance only the selected, pre-programmed length. More specifically, the process begins when fender blank 203 is placed in loading region 79 adjacent to gap 25. Controller 143 activates first roller 21 to rotate clockwise (as shown in FIG. 2) and second roller 23 to rotate counter clockwise (as shown in FIG. 2). This combination of rotations of first and second rollers 21, 23 serves to pull substantially planar portion 201 of fender blank 203 through gap 25. As fender blank 203 is pulled inward by first and second rollers 21, 23, sensing wheel 135 is rotated.

Figure 3:
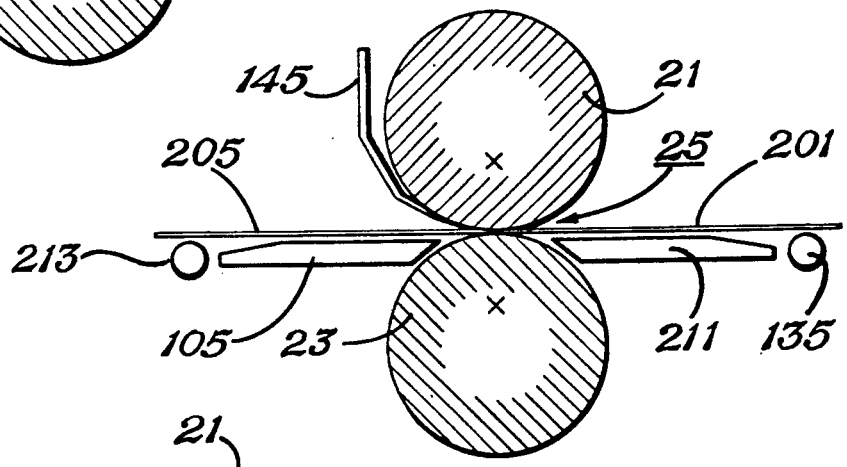

Controller 143 receives an electrical signal indicating the number of revolutions made by sensing wheel 135. Thereafter, controller 143 simply translates this rotational motion into a measure of length. Controller 143 continuously compares the measure of length derived from the action of sensing wheel 135 to the pre-programmed selected length. When the measured length equals the pre-programmed length, first and second roller 21, 23 stop, as shown in FIG. 3.

Figure 4:
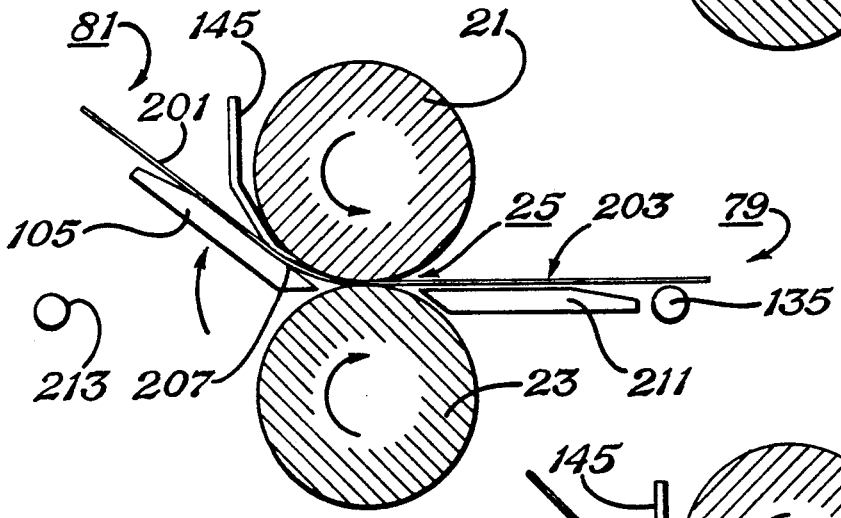

Next, in FIG. 4, selected length 205 of fender blank 203 is retracted through gap 25 at a selected rate. More specifically, controller 143 actuates hydraulic motor 103 to rotate first roller 21 counter clockwise, and second roller 23 clockwise at a selected rate. First and second rollers 21, 23 pull fender blank 203 back through gap 25 from forming region 81 to loading region 79. Simultaneous with the retraction of fender blank 203 through gap 25, forming shoe 105 is pivoted upward through a selected angle at a selected rate. More specifically, controller 143 actuates hydraulic cylinder 137, causing piston 139 to move upward at a pre-programmed rate, and through a pre-programmed arc, causing forming shoe 105 to bend substantially planar portion 201 of fender blank 203 against first roller 21, thereby forming a curve 207 in fender blank 203. Wiper 145 serves to prevent buckling or wrinkling of fender blank 203 as it is being simultaneously bent and retracted through gap 25.

Figure 5:
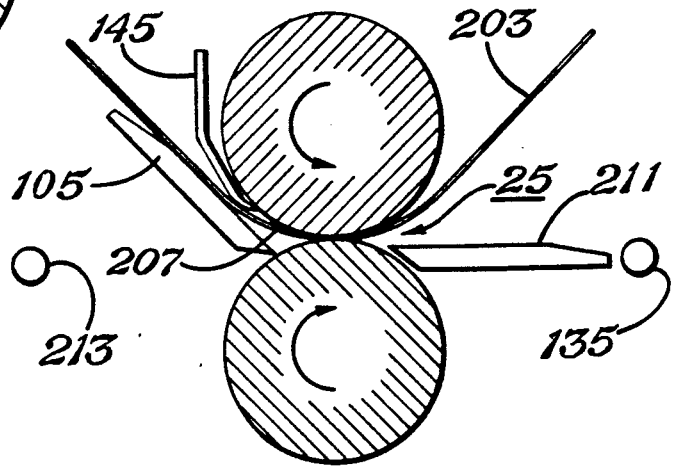

FIG. 5 depicts forming shoe 105 fully extended. In this view, forming shoe 105 is shown at the top of the arc through which it travels. When forming shoe 105 is fully extended upward, it very nearly makes contact with wiper 145 which is rigidly coupled to roller stands 17, 19 of FIG. 1. However, a small gap is provided between wiper 145 and forming shoe 105 which allows the continued retraction of fender blank 203. As first and second roller 21, 23 continue retracting fender blank 203 through gap 25, additional curvature is added to fender blank 203.

As shown in FIG. 5, fender blank 203 is lifted off sensing wheel 135. Of course, sensing wheel 135 can not longer accurately sense the length of fender blank 203 retracted through gap 25 when the fender blank 203 is so elevated. However, controller 143 can accurately calculate the length retracted through gap 25 by use of an internal clock, coupled with the control of the rate of rotation of first and second rollers 21, 23, and the selected length 205 of fender blank 203 stored in the memory of controller 143.

The fender forming system of the present invention is superior to prior art systems in several respects. One outstanding feature is that a curve 20 may be formed in substantially planar portion 201 of fender blank 203, with a single pass of the fender blank 203 between first and second rollers 21, 23, unlike the prior art systems which require more than one pass of the fender blank 203 between rollers to form a curve in a substantially planar portion of a fender blank. This feature results in considerable time savings in the manufacturing process.

The present fender forming system may be adapted to allow for the forming of curves in a substantially planar portion of a fender blank from either side of the apparatus. This is accomplished by providing first and second forming shoes on each side of gap 25. Of course, a wiper 145 must also be provided on each side of gap 25, as well as a sensing wheel 135. FIGS. 2 through 5 are adapted, in part, to demonstrate the configuration of two forming shoes one on each side of gap 25.

In FIG. 2, forming shoe 105 is on one side of gap 25, while second forming shoe 211 is on the opposite side of gap 25. When fender blank 203 is fed through gap 25 from loading region 79 to forming region 81, second forming shoe 211 serves as a loading platform upon which fender blank 203 is disposed. Once fender blank 203 has been fed through gap 25, forming shoe 105 cooperates with first and second rollers 21, 23 to form a curve therein. Sensing wheel 135 serves to measure the length of fender blank 203 that is advanced by first and second rollers 21, 23 through gap 25.

In this configuration, fender blank 203 may also be inserted from the opposite side of first and second rollers 21, 23. If so, forming shoe 105 serves as a loading platform while second forming shoe 211 cooperates with first and second rollers 21, 23 to form a curve in substantially planar portion 201 of fender blank 203. Second sensing wheel 213 serves to measure the selected length 205 of fender blank 203 that is advanced through gap by rotation of first and second rollers 21, 23. Of course, if fender blank 203 is to be inserted from this side of first and second rollers 21, 23, the direction of rotation of the first and second rollers 21, 23 must be opposite the directions shown in FIGS. 2 through 5. For purposes of clarity, only one wiper 145 is depicted in FIGS. 2 through 5; it is understood that a wiper identical to wiper 145 is also disposed at loading region 79, allowing operation of the fender forming apparatus from either side.

Providing a fender forming system adapted to allow use from either side presents significant advantages. Workmen may be stationed on both sides of the apparatus to alternate and maximize use of the fender forming apparatus 11, since each worker will spend a considerable amount of time lifting and stacking the fenders ancillary to the curve forming process. Such a dual system further allows each operator to program controller 143 with entirely different parameters for controlling the speed and direction of rotation of first and second rollers 21, 23, the speed and angle through which forming shoes 105, 211 are to be moved, and the desired selected length 205 of fender blank 203 which is to be advanced through first and second rollers 21, 23 for producing differing curvatures from each side of the fender forming apparatus.

The degree of curvature in each fender blank can be identified and quantified by reference to the "radius" of curvature. Essentially, the "radius" is a measure of the imaginary radius required to produce the desire curve if said radius is moved through the arc of the curve in the fender blank. In other words, the radius is a single parameter which quantifies the degree of curvature of the fender blank.

The selected length 205 of fender blank 203 is a variable which must be pre-programmed in controller 143; curve 207 is formed in fender blank 203 with a radius established at least in part through the selected length 205 of substantially planar portion 201 advanced through gap 25 to forming region 81. The degree of curvature or radius is also established at least in part through the selected rate at which fender blank 203 is retracted from forming region 81. Of course, this rate of retraction depends upon the speed of first and second rollers 21, 23 and the selected length of said fender blank 203 to be retracted from forming region 81. The relative selected diameters of first and second rollers 21, 23 also influence the degree of curvature. In the preferred embodiment, first roller 21 has a diameter of approximately ten inches, while second roller 23 has a diameter of approximately four and one-half inches. Additionally, the particular radius of curvature is established also in part by the selected angle or arc through which forming shoe 105 is moved. Of course, the selected rate at which forming shoe 105 is moved through also effects the radius of curvature. The outer limit for the upper movement of forming shoe 105 is set manually by adjustment screw 141 of FIG. 1. However, the rate of motion for forming shoe is pre-programmed through controller 143 and influences the radius of curvature.

While mathematical formulas can certainly be derived which correlate these variables to the degree of curvature, Applicant has found it quite cost effective to establish the parameters of selected length 205, the rate of retraction of fender blank through gap 25, the rate of movement for forming shoe 105, and the selected angle through which forming shoe 105 is moved through an empirical process. Since these parameters will vary with the particular size and style of fender blank, and desired length and degree of curvature, it is not helpful to set forth these parameters. As stated above, they are easily ascertained through a limited amount of empirical experimentation, with little waste of materials and time.

The present invention has a number of advantages over prior art systems. First, a number of significant manufacturing problems and defects are avoided with the present fender forming system. Scuffs, bows, crimps, and knots are minimized, or entirely avoided under the present system. The resulting fenders produced are consequently much more pleasing to view and valuable. Second, the present invention allows for a variety of modes of operation. Workmen stationed on opposite sides of the fender forming apparatus can cooperate to bend opposite ends of the same fender blank. Or workmen stationed on opposite sides of the fender forming apparatus 11 can work independently forming curves at both ends of a fender blank. Also, workmen stationed on either side of the fender forming apparatus can bend fender blanks to form curves having entirely different radiuses of curvature through programming of the controller. Third, the use of a controller substantially eliminates many possibilities for human error, and consequent waste of materials, inaccuracy, and defective or substandard fenders. Moreover, the present invention greatly reduces the amount of time required to form a desired curve in a fender blank. Also, the present system does not require extensive training and expertise to form acceptable curves.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A method of forming a curve having a selected radius in a selected length of a substantially planar portion of a fender blank, comprising:

providing first and second substantially parallel rollers having selected diameters with a gap therebetween adapted to receive said substantially planar portion of said fender blank;

providing a forming shoe at a forming region on one side of said first and second substantially parallel rollers;

providing a programmable controller for controlling rates of movement of said first and second substantially parallel rollers and said forming shoe;

inserting said substantially planar portion of said fender blank in said gap;

rotating at least one of said first and second substantially parallel rollers to advance a selected length of said substantially planar portion of said fender blank through said gap to said forming region over said forming shoe during a loading mode with said forming shoe disposed adjacent said gap but non-obstructive of said substantially planar portion of said fender blank so that said substantially planar portion of said fender blank is not bent by said forming shoe;

rotating at least one of said first and second substantially parallel rollers at a preprogrammed rate to retract a selected length of said fender blank from said forming region through said gap, while simultaneously moving said forming shoe at a preprogrammed rate through a selected angle to bear upon said fender blank and form a curve of selected radius in said fender blank in a single pass; and wherein said first and second substantially parallel rollers and said forming shoe cooperate to form a curve of selected radius in said substantially planar portion of said fender blank in a single pass.

2. The method of forming a curve in a substantially planar portion of a fender blank according to claim 1 wherein the said curve is formed in said fender blank with a radius established at least in part through the selected length of said substantially planar portion advanced through said gap to said forming region.

3. The method of forming a curve in a substantially planar portion of a fender blank according to claim 1 wherein said curve is formed in said substantially planar portion of said fender blank with a radius established at least in part through the selected rate at which said fender blank is retracted from said forming region.

4. The method of forming a curve in a substantially planar portion of a fender blank according to claim 1 wherein said curve is formed in said fender blank with a radius established at least in part through the selected length of said fender blank retracted from said forming region.

5. The method of forming a curve in a substantially planar portion of a fender blank according to claim 1 wherein said curve is formed in said fender blank with a radius established at least in part through the selected angle through which said forming shoe is moved.

6. The method of forming a curve in a substantially planar portion of a fender blank according to claim 1 wherein said curve is formed in said fender blank with a radius established at least in part through the selected rate at which said forming shoe is moved through said selected angle.

7. The method of forming a curve in a substantially planar portion of a fender blank according to claim 1 wherein said curve is formed in said fender blank with a radius established at least in part through the relative selected diameters of said first and second substantially parallel rollers.

8. The method of forming a curve in a substantially planar portion of a fender blank according to claim 1 wherein said forming shoe is moved through a selected arc at a selected rate to bear upon said fender blank.

9. The method of forming a curve in a substantially planar portion of a fender blank according to claim 1 wherein said first and second substantially parallel rollers are rotated at the same selected rate to advance a selected length of said substantially planar portion of said fender blank through said gap to said forming region.

10. The method of forming a curve in a substantially planar portion of a fender blank according to claim 1 wherein said first and second substantially parallel rollers are rotated at the same selected rate to retract said fender blank through said gap away from said forming region.

11. A method of forming curves in substantially planar portions of a fender blank, comprising:

providing first and second substantially planar rollers having selected diameters with a gap therebetween adapted to receive said substantially planar portions of said fender blank;

providing first and second forming shoes on each side of said gap with said first forming shoe disposed adjacent said gap but nonobstructive of said substantially planar portion of said fender blank;

providing a programmable controller for controlling rates of movement of said first and second substantially planar rollers and said first and second forming shoes;

inserting a first substantially planar portion of said fender blank in said gap;

rotating at least one of said first and second substantially parallel rollers to advance a selected length of said first substantially planar portion through said gap toward and over said first forming shoe without bending said fender blank by said first forming shoe;

rotating at least one of said first and second substantially parallel rollers to retract a selected length of said first substantially planar portion through said gap at a preprogrammed rate, while simultaneously moving said first forming shoe through a selected angle at a preprogrammed rate to bear upon said fender blank, wherein said first and second substantially parallel rollers and said first forming shoe cooperate to form a first curve in said first substantially planar portion;

inserting a second substantially planar portion of said fender blank in said gap;

rotating at least one of said first and second substantially parallel rollers to advance a selected length of said second substantially planar portion through said gap toward said second forming shoe; and rotating at least one of said first and second substantially parallel rollers to retract a selected length of said second substantially planar portion through said gap at a preprogrammed rate, while simultaneously moving said second forming shoe through a selected angle at a preprogrammed rate to bear upon said fender blank, wherein said first and second substantially parallel rollers and said second forming shoe cooperate to form a second curve in said second substantially planar portion.

12. A method of forming curves in substantially planar portions of a fender blank according to claim 11 wherein said first and second curves are formed with radiuses established at least in part by at least one of the following:

the selected length of said first and second substantially planar portions, the selected rate at which said first and second portion are retracted from said gap, the selected lengths of said first and second portions retracted through said gap, the selected angle through which said first and second forming shoes are moved, the selected rates at which said forming shoes are moved through said selected angles.

13. A method of forming curves in substantially planar portions of fender blanks according to claim 11, wherein said first curve is formed in a substantially planar portion of a first fender blank and said second curve is formed in a substantially planar portion of a second fender blank.

14. A method of forming curves in substantially planar portions of a fender blank according to claim 11, wherein said first curve and said second curve are formed at opposite ends of the same fender blank.

15. A method of forming curves in substantially planar portions of a fender blank according to claim 11, wherein said first curve is formed in a substantially planar portion of a first fender blank and said second curve is formed in a substantially planar portion of a second fender blank, and wherein said first curve and said second curve are formed with different radiuses.

16. A method of forming curves in substantially planar portions of a fender blank according to claim 11, wherein said first curve and said second curve are formed at opposite ends of the same fender blank, and wherein said first curve and said second curve are formed with different radiuses.

17. An apparatus for forming a curve having a selected radius in a selected length of a substantially planar portion of a fender blank, comprising:

a frame a first roller rotatably carried by said frame;

a second roller substantially parallel to said first roller and rotatably carried by said frame;

a gap between said first and second rollers adapted to allow passage of a selected length of said substantially planar portion of said fender blank from a loading region on one side of said first and second rollers to a forming region on the opposite side of said first and second rollers;

means for rotating said first and second rollers to selectively advance and retract said fender blank through said gap at a selected rate;

a forming shoe in said forming region proximate to but non-obstructive of said gap during a loading stage in which a selected length of said substantially planar portion of said fender blank is pulled through said gap from said loading region by said first and second roller when advanced by said means for rotating to advance said selected length over said forming shoe without bending said selected length;

means for moving said forming shoe through a selected angle at a selected rate causing said forming shoe to bear against said fender blank;

a programmable controller for controlling rates of movement of said means for rotating and said means for moving; and wherein said first and second rollers and said forming shoe cooperate to form a curve in said substantially planar portion of said fender blank during a forming stage in which said first and second rollers are rotated by said means for rotating to retract said fender blank through said gap at a preprogrammed rate while said forming shoe is simultaneously moved through a selected angle at a preprogrammed rate to bear against said fender blank and form said curve of said selected radius in a single pass.

18. An apparatus for forming a curve in a substantially planar portion of a fender blank according to claim 17, further comprising:

a means for controlling at least one of the following to establish at least in part the radius of curvature of said curve formed in said substantially planar portion of a fender blank the selected length of said first and second substantially planar portions, the selected rate at which said first and second portion are retracted from said gap, the selected lengths of said first and second portions retracted through said gap, the selected angle through which said first and second forming shoes are moved, the selected rates at which said forming shoes are moved through said selected angles.

* * * * *